United States Patent [19]

Hölter, et al.

[11] 4,270,326

[45] Jun. 2, 1981

[54] FIREPROOF DOOR FOR HOTELS, SKYSCRAPERS AND THE LIKE

[75] Inventors: Heinz Hölter, Gladbeck; Heinz Gresch, Dortmund-Derne; Heinrich Igelbuscher, Gladbeck, all of Fed. Rep. of Germany

[73] Assignee: Industrie-Wert Beteiligungsgesellschaft mbH, Fed. Rep. of Germany

[21] Appl. No.: 64,599

[22] Filed: Aug. 7, 1979

[30] Foreign Application Priority Data

Aug. 21, 1979 [DE] Fed. Rep. of Germany ..... 2836489
Sep. 11, 1979 [DE] Fed. Rep. of Germany ..... 2839499

[51] Int. Cl.[3] ..... E04B 1/74

[52] U.S. Cl. ..... 52/404; 52/809; 52/793

[58] Field of Search ..... 52/809, 793, 810, 407, 52/404; 49/501

[56] References Cited

U.S. PATENT DOCUMENTS

| | | | |
|---|---|---|---|
| 2,652,601 | 9/1953 | Slopa et al. | 52/793 |
| 3,238,677 | 3/1966 | Sowbier | 52/809 X |
| 3,254,592 | 6/1966 | Chase | 52/809 X |
| 3,273,297 | 9/1966 | Lueke, Jr. | 52/809 X |
| 3,359,699 | 12/1967 | Jackson | 52/809 X |

FOREIGN PATENT DOCUMENTS

| | | | |
|---|---|---|---|
| 2257862 | 6/1974 | Fed. Rep. of Germany | 52/809 |
| 1138637 | 1/1969 | United Kingdom | 52/809 |

*Primary Examiner*—Carl D. Friedman
*Attorney, Agent, or Firm*—James C. Wray

[57] ABSTRACT

A fireproof door has a fabric of ceramic or glass fibers attached to a metal frame and covered by facings. The fabric which also may be used as a fireproof mat consists of layers of titanium-treated ceramic or glass fibers felted together by similar needlelike fibers extending through an intermediate layer of fireproof particulate material.

12 Claims, 3 Drawing Figures

FIG. 1
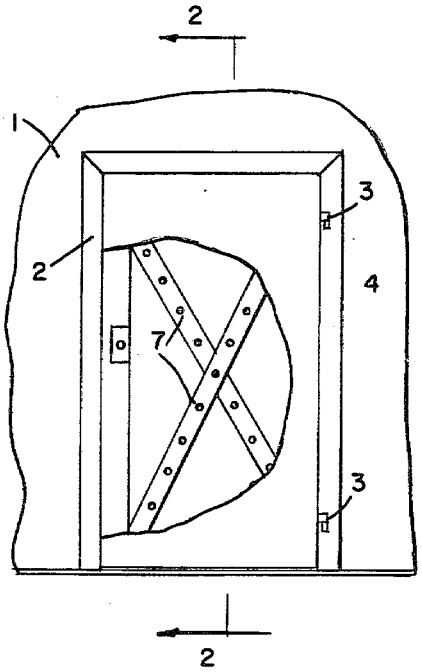
FIG. 3
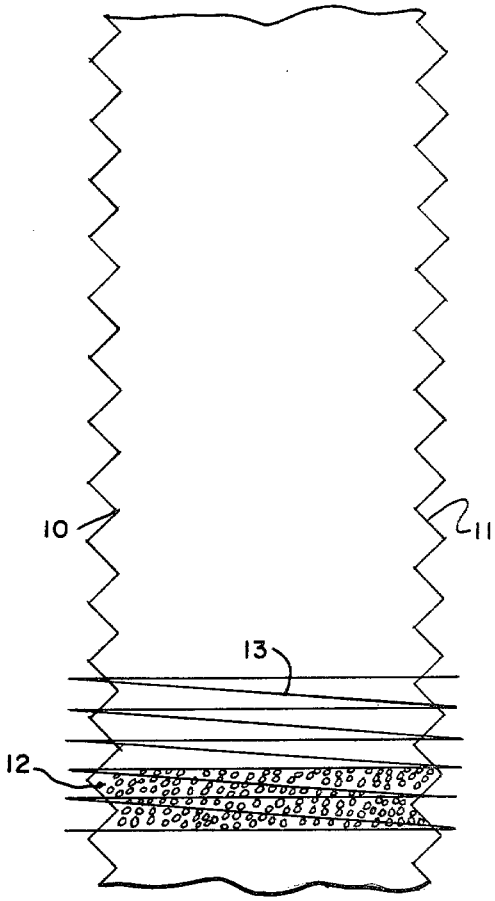
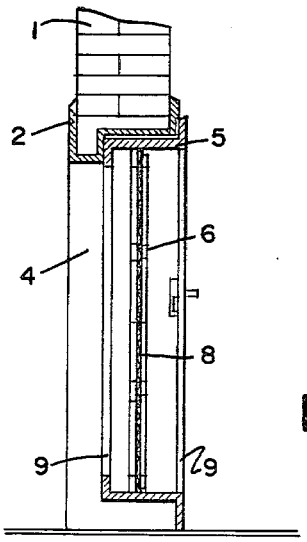
FIG. 2

FIREPROOF DOOR FOR HOTELS, SKYSCRAPERS AND THE LIKE

BACKGROUND OF THE INVENTION

The invention concerns a fireproof door, especially for hotels, skyscrapers and similar buildings consisting of a metal frame with metallic mountings and fittings, an insulation layer made of fireproof material inside of the metal frame as well as a facing fixed to the metal frame.

Such fireproof doors are used to confine a fire within one or several rooms of buildings such as hotels and skyscrapers and to prevent spreading of the fire to other rooms and/or halls.

Known are fireproof doors with an insulation layer consisting of compressed fireproof materials which practically fill out the space between the lining of the door. The metal frames and the fittings, for example holding and opening devices, and hinges can be made of steel, preferably a high temperature-resistant steel. Steel plates are used as facings or sheathing, which can be coated. Those steel plates also provide support for the compressed fireproof materials. Nevertheless, it has been frequently observed that, after a long term use of the door, especially by slamming of the door, the fireproof materials enclosed between the steel plates will settle. Therefore, in case of a fire, the heat-resistant properties of the door at least are reduced or in severe cases even are non-existent. In addition, known fireproof doors are relatively expensive and they are so heavy in weight, that they can be opened and closed only with extreme effort. These are some reasons that such fireproof doors are not often used in hotels and skyscrapers. Most of the time people can be rescued from buildings, which don't have fireproof doors, through windows or by means of fire rescue devices such as ladders and jumping nets. However, the fire will continue to spread.

An object of the invention is to improve the construction of a fireproof door as described before, which is inexpensive to produce, which is low in weight and which will keep its fire-resistant properties even after a long term use.

The solution is an insulation layer made of an elastic, flexible, fireproof textile fabric fixed inside of the metal frame.

Such a fabric may be attached to a special support layer which itself is fixed to the metal frame. By this procedure settlement of the insulation layer can be prevented even after long term use, and therefore reduction of the heat-resistance of the door is prevented. Furthermore, an elastic, flexible, fireproof fabric can always be fixed to the metal frame or to a support layer in such a way that a shifting or displacement of the fabric is impossible.

As fireproof fabrics, especially fabrics made of ceramic fibers, preferably glass fibers are suitable. Even though such fibers have relatively low bending strength properties, fabric made of those fibers is still flexible and elastic enough to resist considerable stress and strain conditions. Furthermore, the ceramic fibers and/or glass fibers have high heat-insulating and fire-resistant properties, especially when the fibers are treated, for example, with a metal. Titanium is recommended as a metal for treating the fibers.

The fire-resistant properties of the door can be even improved if the insulation layer at least consists of two fabric layers. Those fabric layers are specially linked or felted with each other through a granular heat-insulating material. The thus formed needlelike fibers hold the layers together and prevent the granular material from shifting. Such a mat formed of two or several of those fabric layers is also flexible and will resist considerable stress and strain conditions. It is recommended to preferably use perlite and/or vermiculite as the granular, heat-insulating material.

Because the insulation layer of such a constructed door does not need to be held by the facing of the door, the usage of steel plates as a facing is not required anymore. Instead of steel plates, facings made of wood or wood fiber materials, plastic or similar materials may be used. The weight of those materials is low and will considerably reduce the total weight of the door. Furthermore, the surface of those facings can have a special finishing or ornamentation, such that one cannot determine immediately that the door is a fireproof door.

In the following, the invention will be described in more detail together with the drawings shown on two separate pages.

BRIEF DESCRIPTION OF THE DRAWINGS

FIG. 1 is a view of a fireproof door with partiallly removed lining.

FIG. 2 is a cross-section along lines II—II of the fireproof door as shown in FIG. 1.

FIG. 3 is a partial cross-section of another fireproof door according to FIG. 2.

DETAILED DESCRIPTION OF THE DRAWINGS

FIG. 1 partially shows a wall 1, which includes the casing 2 for a hotel door. The casing 2 can be made of ordinary steel or high temperature resistant steel.

By means of hinges 3 a door 4 is attached to the casing 2. The door consists of a metal frame 5 and a supporting device 6. In the example shown in FIGS. 1 and 2, the supporting device consists of diagonal bracing 7 stiffening the metal frame 5.

The supporting device 6 serves as a support for and a fixation of an elastic, flexible and fireproof fabric 8. In the example shown in FIGS. 1 and 2, this fabric consists of ceramic fibers such as glass fibers tempered with titanium. The fireproof fabric 8 forms a high temperature resistant fire shield, which is able to withstand temperatures up to 1400° C. The fireproof fabric will always stay in its position during long term use, even if the door is frequently slammed and/or if the frame is distorted.

Furthermore, the door 4 has on its front and rear side, facings 9 which can be made of wood or wood-fiber panels or molded fiber boards.

FIG. 3 shows a partial cross-section of an insulation layer of a door 4. This insulation layer consists of two parallel fabric layers 10 and 11 made of materials as described before. Between these fabric layers a layer 12 of granular, heat-insulating material is arranged, such as perlite or vermiculite. Both fabric layers 10 and 11 are linked or felted together in a special needlelike manner with needlelike fibers 13 to prevent the granular material 12 from shifting relative to both layers or from falling out the gap between the layers.

Mats made of the fabric 8 or the fabric layers 10 and 11 and the insulating layer 12 not only can be used inside fireproof doors but also can be used as fire-protection mats. Those mats will then be installed in a rolled-up position and in case of a fire, they will be automatically released, forming a flexible fire-protection curtain.

We claim:

1. Fireproof door, especially for hotels, skyscrapers, or similar buildings consisting of a metal frame with metal fittings and an insulation layer made of fireproof material arranged inside the metal frame as well as a facing attached to the metal frame, wherein the insulation layer is made of an elastic, flexible, fireproof fabric made of ceramic fibers and the layer is fixed to the metal frame.

2. The fireproof door according to claim 1, wherein the fabric is attached to a supporting device which itself is fixed to the metal frame.

3. The fireproof door according to claim 1 wherein the fireproof fabric is made of glass fibers.

4. The fireproof door according to one or the other of the claims 1 or 2 wherein the fibers are treated.

5. The fireproof door according to one or the other of claims 1 or 2 wherein the insulation layer consists of at least two fabric layers which are specially linked together in a felted needlelike manner with needlelike elements with a granular, heat-insulating material inbetween.

6. The fireproof door according to claim 5 wherein the granular, heat-insulating material is perlite or vermiculite.

7. Fireproof door, especially for hotels, skyscrapers, or similar buildings consisting of a metal frame with metal fittings and an insulation layer made of fireproof material arranged inside the metal frame as well as a facing attached to the metal frame, wherein the insulation layer is made of an elastic, flexible, fireproof fabric made of fibers treated with a metal and the layer is fixed to the metal frame.

8. The fireproof door according to claim 7, wherein the fabric is attached to supporting device which itself is fixed to the metal frame.

9. The fireproof door according to claims 7 or 8 wherein the fireproof fabric is made of ceramic fibers.

10. The fireproof door according to claim 7 wherein the fireproof fabric is made of glass fibers.

11. The fireproof door according to one or the other of claims 7 or 8 wherein the insulation layer consists of at least two fabric layers which are specially linked together in a felted needlelike manner with needlelike elements with a granular, heat-insulating material inbetween.

12. The fireproof door according to claim 11 wherein the granular, heat-insulating material is perlite or vermiculite.

* * * * *